US008142225B2

(12) United States Patent
Yu

(10) Patent No.: US 8,142,225 B2
(45) Date of Patent: Mar. 27, 2012

(54) ELECTRICAL CONNECTOR SOLDERED ON A PRINTED CIRCUIT BOARD

(75) Inventor: Sheng-Nan Yu, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 4 days.

(21) Appl. No.: 12/870,070

(22) Filed: Aug. 27, 2010

(65) Prior Publication Data

US 2012/0052697 A1 Mar. 1, 2012

(51) Int. Cl.
*H01R 13/648* (2006.01)

(52) U.S. Cl. ..... 439/607.35; 439/83

(58) Field of Classification Search ..... 439/79, 439/80, 83, 569, 570, 607.35, 607.36, 607.38, 439/939

See application file for complete search history.

(56) References Cited

U.S. PATENT DOCUMENTS

| | | | | |
|---|---|---|---|---|
| 5,928,035 | A * | 7/1999 | Jankowsky et al. | 439/607.36 |
| 6,652,317 | B2 * | 11/2003 | Shao | 439/607.35 |
| 6,659,799 | B2 * | 12/2003 | Yang | 439/607.19 |
| 7,182,610 | B2 * | 2/2007 | Lin | 439/79 |
| 7,217,159 | B2 * | 5/2007 | Chung | 439/607.01 |
| 7,497,732 | B2 * | 3/2009 | Yi | 439/607.23 |
| 7,500,876 | B2 * | 3/2009 | Chang | 439/607.05 |

* cited by examiner

*Primary Examiner* — Thanh Tam Le
(74) *Attorney, Agent, or Firm* — WPAT, P.C.; Anthony King

(57) ABSTRACT

An electrical connector is soldered on a printed circuit board. The printed circuit board has a containing gap opened at one side thereof. A top surface of the printed circuit board defines a plurality of first soldering points arranged around the containing gap. Each of two opposite inner sidewalls of the containing gap defines a second soldering point. The electrical connector is located in the containing gap. The electrical connector includes an insulating housing, a plurality of terminals and a shielding shell. The terminals are received in the insulating housing. The shielding shell defines an inserting space enclosing the insulating housing and the terminals. Each side plate has a first soldering portion extended outward and a second soldering portion extended downward therefrom. The second soldering portions are soldered on the second soldering points. The first soldering portions are soldered on the corresponding first soldering points.

1 Claim, 3 Drawing Sheets

ELECTRICAL CONNECTOR SOLDERED ON A PRINTED CIRCUIT BOARD

BACKGROUND OF THE INVENTION

1. Field of the Invention

The present invention generally relates to an electrical connector, and more particularly to an electrical connector which has a shielding shell capable of being soldered to a printed circuit board firmly.

2. The Related Art

With the development of electronic products, connections between a variety of electronic products and peripheral products thereof are more and more popular. The electronic product and the peripheral product thereof are usually connected by a USB connector. So, using frequencies of the USB connector are increased. The USB connector is widely used in the electronic products, the quality of the USB connector is requested higher and higher. In order to meet the quality request of the customers, the manufacturers have to make it firmly connect with a mated connector.

A conventional USB connector includes an insulating housing, a plurality of terminals and a shielding shell. The insulating housing defines a plurality of fillisters for receiving the terminals. A top of the insulating housing defines a plurality of indentations. The shielding shell has a rectangular shielding shell with a top plate, a bottom plate and two opposite side plates. Two rear portions of the two opposite side plates respectively extend outward to form two soldering portions. The soldering portions are soldered to the corresponding soldering contacts of a printed circuit board, so that the whole shielding shell will be fastened on the printed circuit board. Several portions of the shielding shell are punched inward to form a plurality of splinters. In assembly, the splinters will be fastened in the indentations. The shielding shell encloses the terminals and the insulating housing.

In use, when a mated connector is inserted into the shielding shell of the USB connector, if the operator exerts a larger pressure to make the soldering contact afford a larger horizontal force, it will be apt to make copper foil which is covered on the soldering contact of the printed circuit board loose. After being used many times, the copper foil may fall off from the soldering contact of the printed circuit board. On the other hand, if the user makes a mistake of moving away the USB connector, the soldering portion will afford a larger upward pulling force, it will be apt to make the copper foil which is covered on the soldering contact be torn open, so that a bad influence will be brought to the electrical connection of the soldering portion and the printed circuit board. Therefore, the USB connector may work abnormally, the using life of the USB connector may also be affected.

SUMMARY OF THE INVENTION

An object of the present invention is to provide an electrical connector adapted for being soldered on a printed circuit board. The printed circuit board has a containing gap opened at one side thereof. A top surface of the printed circuit board defines a plurality of first soldering points arranged around the containing gap. Each of two opposite inner sidewalls of the containing gap defines a second soldering point. The electrical connector is located in the containing gap. The electrical connector includes an insulating housing, a plurality of terminals and a shielding shell. The terminals are received in the insulating housing. The shielding shell has a top plate, a bottom plate and two side plates which are interconnected to form an inserting space enclosing the insulating housing and the terminals. Each side plate has a first soldering portion extended outward and a second soldering portion extended downward therefrom. The first and second soldering portions are spaced from each other. The second soldering portions are soldered on the second soldering points of the printed circuit board. The first soldering portions are soldered on the corresponding first soldering points of the printed circuit board.

As described above, the second soldering portion are vertically soldered on the second soldering points of the printed circuit board to make the electrical connector mounted to the printed circuit board, so when the mated connector is inserted into the inserting space of the shielding shell, the interacting force between copper foils which is covered on the printed circuit board and the printed circuit board will be decreased, then the possibility of the copper foils falling off from the printed circuit board will be greatly decreased. Therefore, a steady electrical connection between the electrical connector and the printed circuit board is realized, the life of the electrical connector is lengthened.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENT

Figure 2:
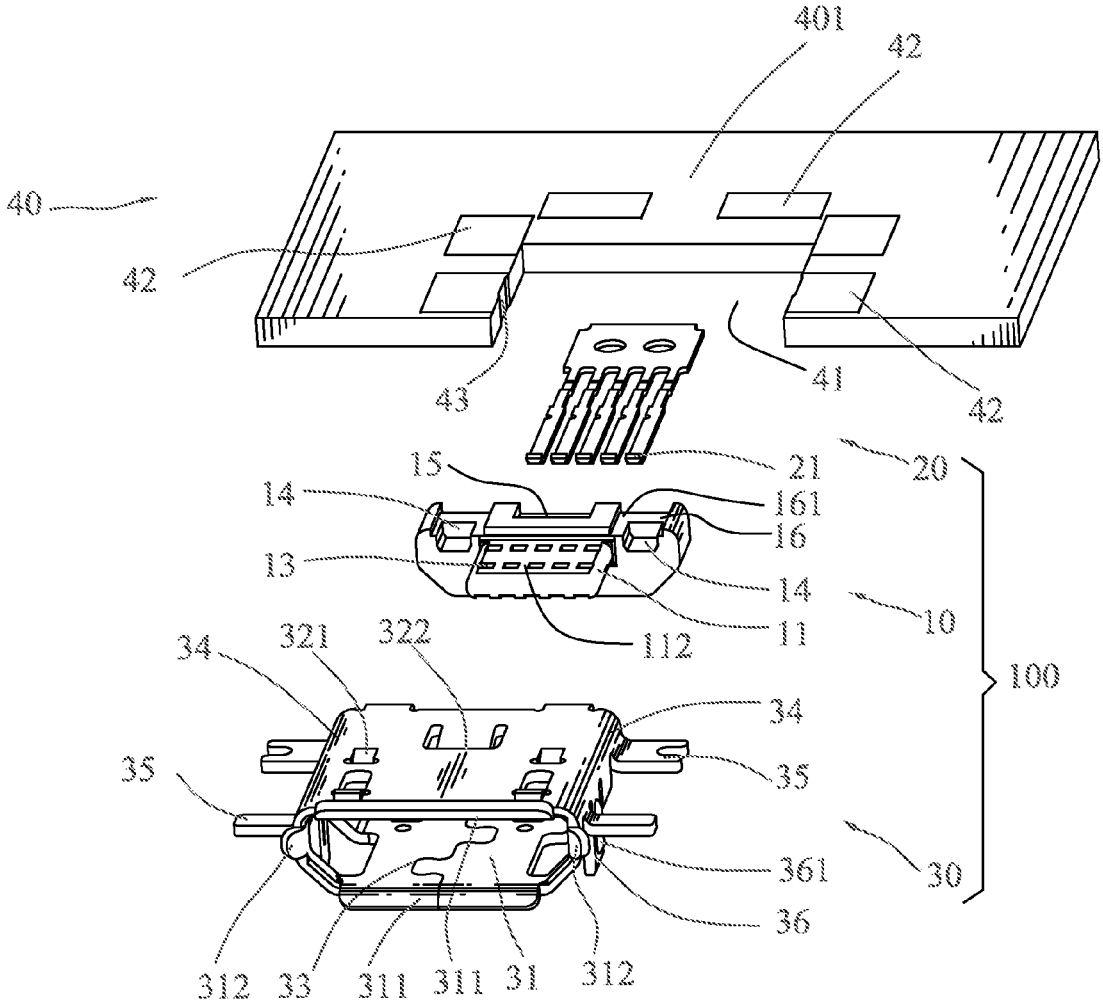
FIG. 2 is an exploded perspective view of the electrical connector of FIG. 1.

Referring to FIG. 2, an electrical connector 100 in accordance with the present invention is used to be soldered to a printed circuit board 40. The electrical connector 100 includes an insulating housing 10, a plurality of conductive terminals 20 received in the insulating housing 10, a shielding shell 30 enclosing the insulating housing 10.

Figure 3:
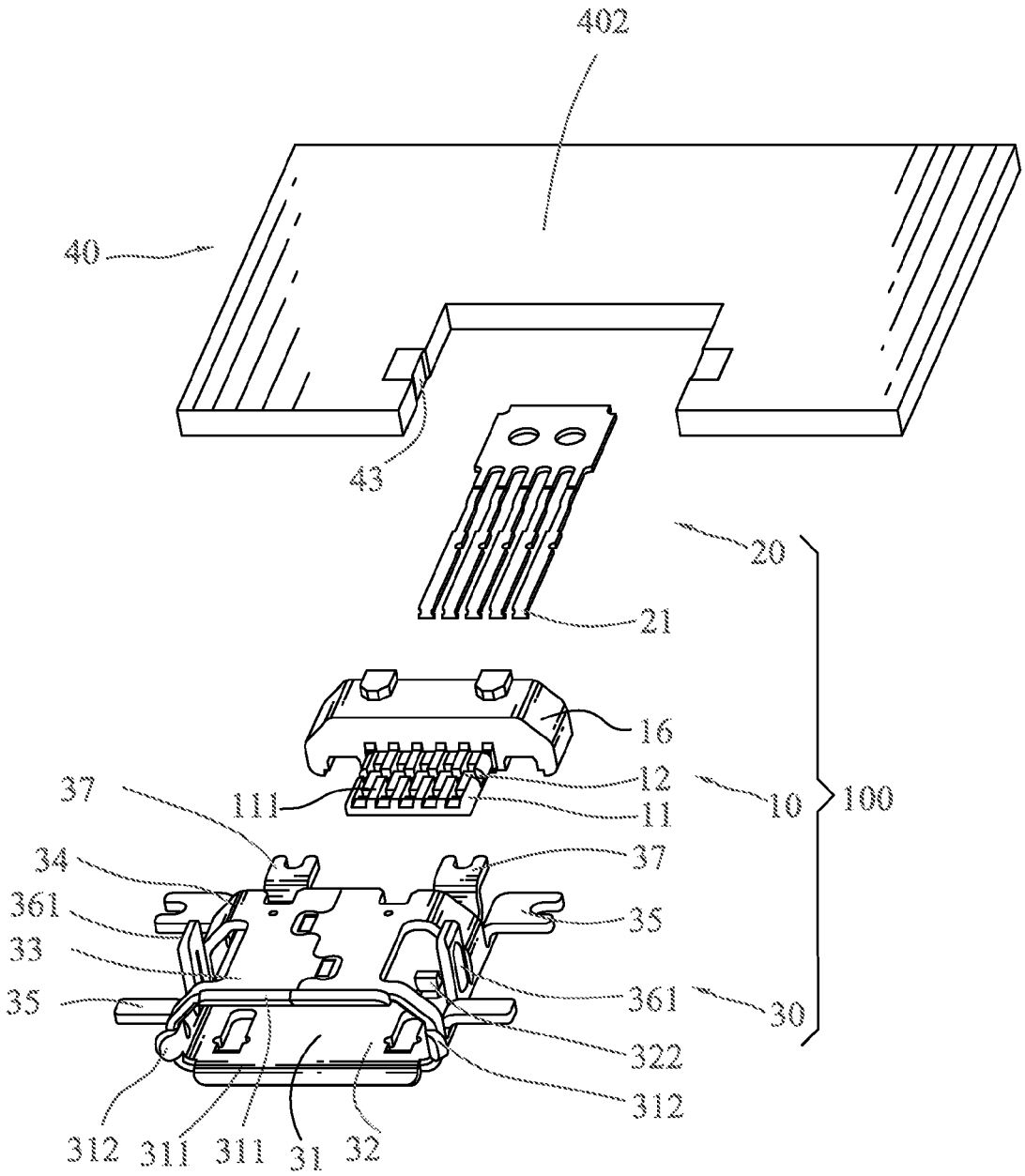
FIG. 3 is another angle exploded perspective view of the electrical connector of FIG. 1.

Referring to FIG. 2-FIG. 3, the insulating housing 10 includes a base portion 16 and a tongue board 11 extended frontward from a front of the base portion 16. A bottom surface 111 of the tongue board 11 defines a plurality of fillisters 12 extending along a front-to-rear direction. A front and a rear of a top surface 112 of the tongue board 11 define two parallel rows of through-holes 13 vertically penetrating therethrough, respectively. Each two longitudinally arranged through-holes 13 are communicated with the corresponding fillisters 12. Two sides of a top surface 161 of the base portion 16 define two clipping grooves 14 passing through the front of the base portion 16. A middle of the top surface 161 of the base portion 16 defines a recess 15 passing through a rear end of the base portion 16. A free end of each conductive terminal 20 is bent upward to form a fastening portion 21.

Figure 1:
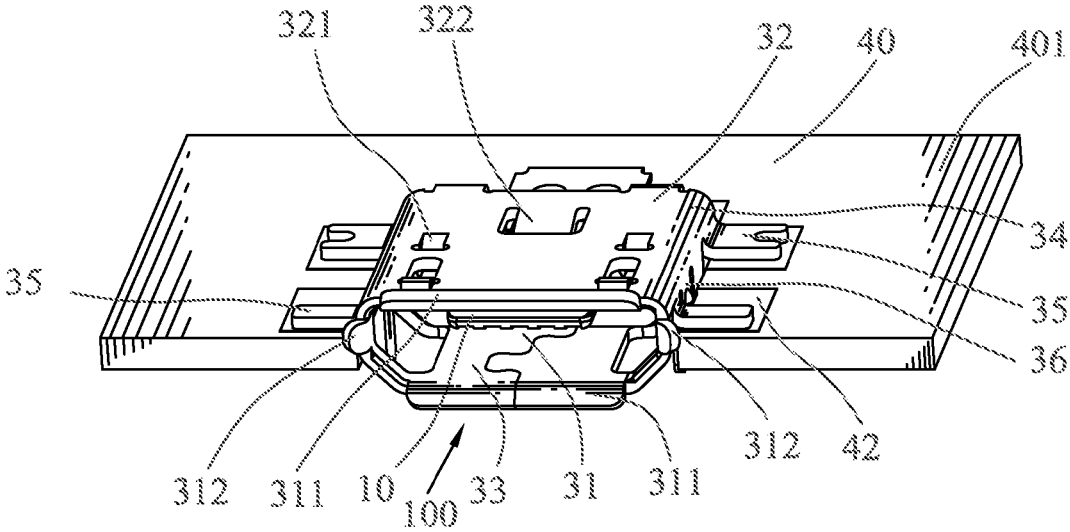
FIG. 1 is a perspective view of an electrical connector according to the present invention.

Referring to FIG. 1-FIG. 3, the shielding shell 30 has a top plate 32, a bottom plate 33 and two side plates 34 which are interconnected to form an inserting space 31 thereamong. A front portion and a rear portion of each side plate 34 respectively extend outwardly and horizontally to form a first soldering portion 35. A portion of each side plate 34 extends downward to form a second soldering portion 36 located between the two first soldering portions 35. An outer side of each second soldering portion 36 is protruded outward to form a first protrusion 361. Two sides of the top plate 32 are punched inward to form two first splinters 321. A rear portion of the top plate 32 is punched inward to form a second splinter 322. Two portions of a rear end of the top plate 32 are bent downward, and then are bent rearward to form two third soldering portions 37 spaced from each other. The first soldering portion 35 and the third soldering portion 37 are substantially located at substantially a half height of the electrical connector 100 to make the electrical connector 100 be soldered to the printed circuit board 40 swiftly, and make an upper half portion of the electrical connector 100 symmetrical to a lower half portion of the electrical connector 100 concerning the printed circuit board 40 to balance a pressure of the electrical connector 100 exerted to the printed circuit board 40. On the other hand, two front ends of the top plate 32 and the bottom plate 33 are respectively inclined outward to form a first guiding portion 311. Front ends of the two side plates 34 are respectively inclined outward to form a second guiding portion 312. A mated connector is inserted into the inserting space 31 of the electrical connector 100 through the first guiding portions 311 and the second guiding portions 312 to reach an electrical connection of terminals of the mated connector and the conductive terminals 20 of the electrical connector 100.

Referring to FIGS. 1-3, when the electrical connector 100 is assembled, the conductive terminals 20 are assembled to the fillisters 12 of the tongue board 11 with the fastening portions 21 being received in front ends of the fillisters 12 and two portions of each of the conductive terminals 20 being exposed from the through-holes 13 of the insulating housing 10, so that the conductive terminals 20 are fastened in the insulating housing 10. Then, the insulating housing 10 is inserted into the shielding shell 30 from a front of the shielding shell 30. The first splinters 321 are pressed in the clipping grooves 14 and the second splinter 322 is pressed in the recess 15.

Referring to FIGS. 1-3 again, the electrical connector 100 is soldered on the printed circuit board 40 with a containing gap 41 being opened at one side thereof. A top surface 401 of the printed circuit board 40 defines a plurality of first soldering points 42 arranged around the containing gap 41. Two opposite inner sidewalls of the containing gap 41 respectively defines a second soldering point 43. When the electrical connector 100 is mounted to the printed circuit board 40, the electrical connector 100 is positioned in the containing gap 41 with the first soldering portions 35 and the third soldering portions 37 being soldered on the first soldering points 42. The first protrusions 361 are soldered on the second soldering points 43.

As described above, the first protrusions 361 of the second soldering portion 36 are vertically soldered on the second soldering points 43 of the printed circuit board 40 to make the electrical connector 100 mounted to the printed circuit board 40, so when the mated connector is inserted into the inserting space 31 of the shielding shell 30, the interacting force between copper foils which is covered on the printed circuit board 40 and the printed circuit board 40 will be decreased, then the possibility of the copper foils falling off from the printed circuit board 40 will be greatly decreased. Therefore, a steady electrical connection between the electrical connector 100 and the printed circuit board 40 is realized, the life of the electrical connector 100 is lengthened.

What is claimed is:

1. An electrical connector adapted for being soldered on a printed circuit board, the printed circuit board having a containing gap opened at one side thereof, a top surface of the printed circuit board defining a plurality of first soldering points arranged around the containing gap, each of two opposite inner sidewalls of the containing gap defining a second soldering point, the electrical connector located in the containing gap, comprising:

an insulating housing;

a plurality of terminals received in the insulating housing; and a shielding shell having a top plate, a bottom plate and two side plates which are interconnected to form an inserting space enclosing the insulating housing and the terminals, each side plate having a first soldering portion extended outward and a second soldering portion extended downward therefrom, the first and second soldering portions spaced from each other, wherein the second soldering portions are soldered on the second soldering points of the printed circuit board, the first soldering portions are soldered on the corresponding first soldering points of the printed circuit board, wherein each side plate of the shielding shell has two first soldering portions, the second soldering portion are located between the two first soldering portions.

* * * * *